US005950596A

United States Patent [19]

Kollmann

[11] Patent Number: 5,950,596

[45] Date of Patent: Sep. 14, 1999

[54] FUEL INJECTOR DEFLECTOR

[75] Inventor: James D. Kollmann, Mt. Calvary, Wis.

[73] Assignee: Brunswick Corporation, Lake Forest, Ill.

[21] Appl. No.: 08/959,472

[22] Filed: Oct. 28, 1997

[51] Int. Cl.[6] ..... F02B 17/00

[52] U.S. Cl. ..... 123/298; 123/305; 123/585

[58] Field of Search ..... 123/298, 305, 123/470, 585

[56] References Cited

U.S. PATENT DOCUMENTS

| | | | |
|---|---|---|---|
| 3,919,982 | 11/1975 | Goto et al. | 123/32 E |
| 3,954,089 | 5/1976 | Hardesty et al. | 123/30 |
| 4,051,820 | 10/1977 | Boyesen | 123/73 A |
| 4,318,377 | 3/1982 | Occella et al. | 123/279 |
| 4,759,335 | 7/1988 | Ragg et al. | 123/531 |
| 5,115,774 | 5/1992 | Nomura et al. | 123/276 |
| 5,438,968 | 8/1995 | Johnson et al. | 123/446 |

*Primary Examiner*—Willis R. Wolfe
*Assistant Examiner*—Mahmoud M. Gimie
*Attorney, Agent, or Firm*—William D. Lanyi

[57] ABSTRACT

A cylinder wall fuel injector is provided with a deflector that causes a fuel spray to be deflected from its normal path directly across a cylinder and perpendicular to a centerline of the cylinder. The deflector is positioned between an opening in the tip of the fuel injector and the cylinder into which the fuel is sprayed. The deflector causes the fuel to be redirected away from a direct line toward the exhaust port of the cylinder.

14 Claims, 5 Drawing Sheets

FUEL INJECTOR DEFLECTOR

BACKGROUND OF THE INVENTION

1. Field of the Invention

The present invention is generally related to a deflector placed in the path of a fuel spray emitted from an injector and, more particularly, to a conduit which is formed in the shape of a spoon-like surface and provided a flow of pressurized air to deflect and direct the spray of fuel toward a preselected region of a combustion chamber.

2. Description of the Prior Art

Internal combustion engines have been known and used for many years. Certain types of internal combustion engines are provided with fuel injectors. Some systems inject fuel into an air intake manifold of the engine, some inject air directly into the combustion chamber of a cylinder above the top dead center piston position, and others inject fuel through an opening formed in the cylindrical wall of the cylinder at a location below top dead center. Each of these fuel injection techniques have certain advantages and disadvantages and are best suited for certain applications.

When fuel is injected into a cylinder, particularly when the fuel is injected through a wall of the cylinder in a direction toward the exhaust port, some of the fuel may pass directly through the cylinder and out of the exhaust port prior to ignition of the fuel/air mixture within the cylinder.

One solution to the problem described immediately above is to install the fuel injector at an acute angle to a line that is perpendicular to the centerline of the piston and cylinder. By providing this angle, the fuel is injected toward a location that is above the exhaust port and closer to the spark plug. However, when a fuel injector is disposed at this type of angle, much more valuable engine space is used than would otherwise be required for an application where the fuel injector emitted the fuel along a line that is perpendicular to the centerline of the piston and cylinder.

In many applications, the engine designer is faced with the difficult choice of aligning the fuel injector along a line which is perpendicular to the centerline of the engine and piston, which risks the emission of raw fuel through the cylinder and out of the exhaust port prior to ignition or, alternatively, the engine designer can install the fuel injector at an angle to decrease the amount of fuel passing unburned through the exhaust port at the expense of valuable space of the engine block. It would therefore be significantly beneficial if a means could be provided which utilizes a fuel injector that is aligned along a line perpendicular to the centerline of the piston and cylinder, but which can direct the fuel spray in a deflected manner along a path which is not coincident with the exhaust port of the cylinder.

U.S. Pat. No. 5,438,968, which issued to Johnson et. al. on Aug. 8, 1995, relocates to a two-cycle utility internal combustion engine that employs an accumulator-type fuel injector which has an accumulator cavity and a control cavity, both of which are pressurized with fuel to approximately the same pressure. The fuel pressure in the accumulator cavity applies an upward force on a needle, and the fuel pressure in the control cavity applies an opposing downward force on the needle. The accumulator and control cavities are pressurized by means of the reciprocated plunger pump, wherein the plunger is driven by cam appropriate selection of nozzle shape and spatial distribution of the fuel spray droplets can be made to vary favorably over a range of engine loads.

U.S. Pat. No. 3,954,089, which issued to Hardesty et. al. on May 4, 1976, discloses a diesel engine. It is a direct-injection, open-chamber, compression-ignition engine which is designed to operate at high output with a minimum production of oxides of nitrogen by a combination of fuel-air ratios, air-delivery swirl, fuel injection rates, and pattern, diameter and configuration of combustion chambers whereby noxious emissions are substantially reduced.

SUMMARY OF THE INVENTION

An internal combustion engine made in accordance with the present invention comprises an engine block with at least one cylinder formed therein. The cylinder is shaped to receive a piston that is moveable in a reciprocating motion within the cylinder. A fuel injector is attached to the engine block and disposed to emit a spray of fuel in a direction generally along a first axis through an opening formed in a wall of the cylinder. A deflector is at least partially disposed between the injector and the cylinder, the deflector being disposed at an angle to the first axis so that at least a portion of the spray of fuel emitted from the injector will strike a surface of the deflector.

In certain embodiments of the present invention, the deflector is positioned so that the fuel will be deflected in a direction toward a spark plug and away from the exhaust port of the cylinder. The surface of the deflector can be a concave surface against which the spray of fuel impacts after being emitted by the injector. Alternatively, the surface of the deflector can have a convex surface. It should be understood that the specific shape of the deflector surface will depend on the lobe means on the crankshaft, and injection is initiated by venting fuel from the control cavity through a two-way solenoid valve. Injection mass is varied by variation of the ignition timing relative to pump plunger top dead center. Engine power output is varied between full power and idle by skip-firing, which is caused by non-injection in fuel in the engine cylinder during one or more engine crankshaft cycles during a series of a pre-determined number of crankshaft cycles.

U.S. Pat. No. 5,115,774, which issued to Nomura et. al. on May 26, 1992, describes an internal combustion engine which has an air blast valve which injects fuel together with pressured air in the form of a conical shaped spray of fuel. A depression is formed on the top face of the piston, and the conical shaped spray of fuel is injected from the air blast valve toward the depression. The longitudinal width of the depression in the moving direction of the spray of fuel is larger than the transverse width of the depression in the direction perpendicular to the moving direction of the spray of fuel, and the opposing sidewalls of the depression, which define the transfers width of the depression, are positioned slightly outward from the side face of the conical shaped spray of fuel.

U.S. Pat. No. 4,759,335, which issued to Ragg et. al. on Jul. 26, 1988, discloses a direct fuel injection by compressed gas. The method and apparatus is intended for use with in-cylinder injection within an internal combustion engine. Compressed air is used to inject the fuel through an injection nozzle particularly shaped so that different fuel spray patterns are produced at high and low fueling rates. At higher rates of fueling corresponding to higher engine loads, the spray pattern is narrower and penetrates further into the cylinder volume; whereas at lower rates of fueling corresponding to lower engine loads, the fuel spray pattern is wider, less penetrating and relatively more confined. By application of the fuel injector and the particular characteristics of the fuel spray pattern which are desired in that application.

In a particularly preferred embodiment of the present invention, the deflector can be hollow in order to form a conduit for a gas to flow through the deflector and out of an aperture formed proximate a tip of the deflector and disposed within the spray of fuel. A pressurized air supply is connected to the hollowed deflector. The air flows through the deflector toward the aperture of the deflector where it exits from the hollow deflector and into the spray of fuel as the spray is deflected by the curved surface of the deflector. This flow of air performs two valuable functions for the present invention. First, it continues to direct the fuel spray in the direction toward which the fuel was deflected by the deflector surface. Secondly, it can possibly create a finer mist of fuel droplets and counteract any coagulation of mist droplets that might occur because of the contact between the fuel mist and the curved surface.

The flow of air through the conduit of the deflector can be provided by a compressor in certain embodiments of the present invention. Alternatively, the air might be pressurized within the crankcase of the engine during movement of the piston away from top dead center, stored in an accumulator, and then allowed to travel through the hollow deflector toward the aperture. However, it should be clearly understood that the specific means by which the air is provided to the hollow deflector is not limiting to the present invention.

BRIEF DESCRIPTION OF THE DRAWINGS

The present invention will be more fully and completely understood from a reading of the description of the preferred embodiment in conjunction with the drawings, in which.

DESCRIPTION OF PREFERRED EMBODIMENT

Figure 1:
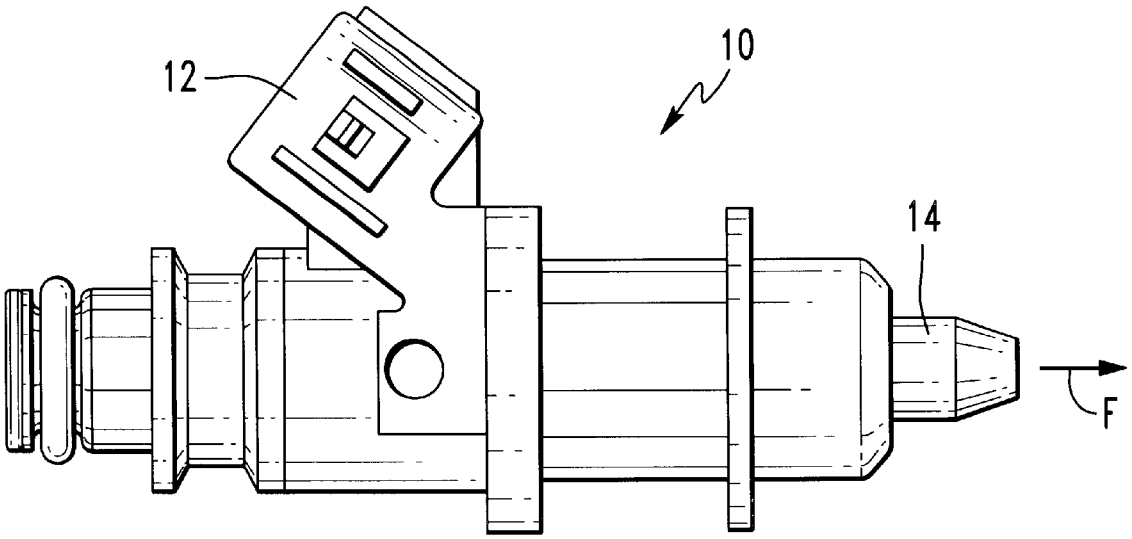
FIG. 1 PRIOR ART
FIG. 1 shows a known type of fuel injector.

Throughout the description of the preferred, like components will be identified by like reference numerals.

FIG. 1 shows a known type of fuel injector 10 which can be electrically controlled by a valve actuation portion 12 to open and close a conduit within the fuel injector (not shown in FIG. 1) through which liquid fuel passes prior to being emitted from an opening in a tip 14. In FIG. 1, arrow F generally shows the direction in which the fuel is emitted from the injector 10. At the other end of the injector which is opposite from the tip 14, an opening (not shown in FIG. 1) of the injector is typically connected to a pressurized fuel supply such as a fuel rail. When the fuel injector 10 is electronically activated, pressurized fuel is allowed to flow from the fuel rail, through the body of the fuel injector 10, and out of the opening in the tip 14 as represented by arrow F.

Figure 2:
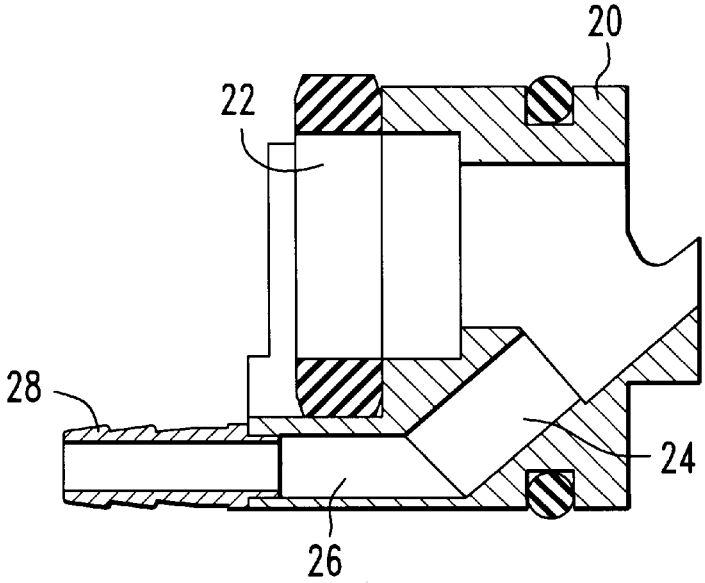
FIG. 2 shows an adapter of the present invention.

FIG. 2 shows a structure which comprises a portion of the present invention. The adapter 20 comprises a first cylindrical opening 22 that is shaped to receive a portion of the fuel injector 10 described above. The adapter 20 also comprises a portion 24 which is shaped to receive a fuel deflector in rigid attachment therein. A gas passage conduit 26 allows a gas, such as compressed air, to pass from a supply tube (not shown in FIG. 2) and through a barbed nipple 28 into a hollow deflector (not shown in FIG. 2) which is located partially within opening 24.

Figure 3:
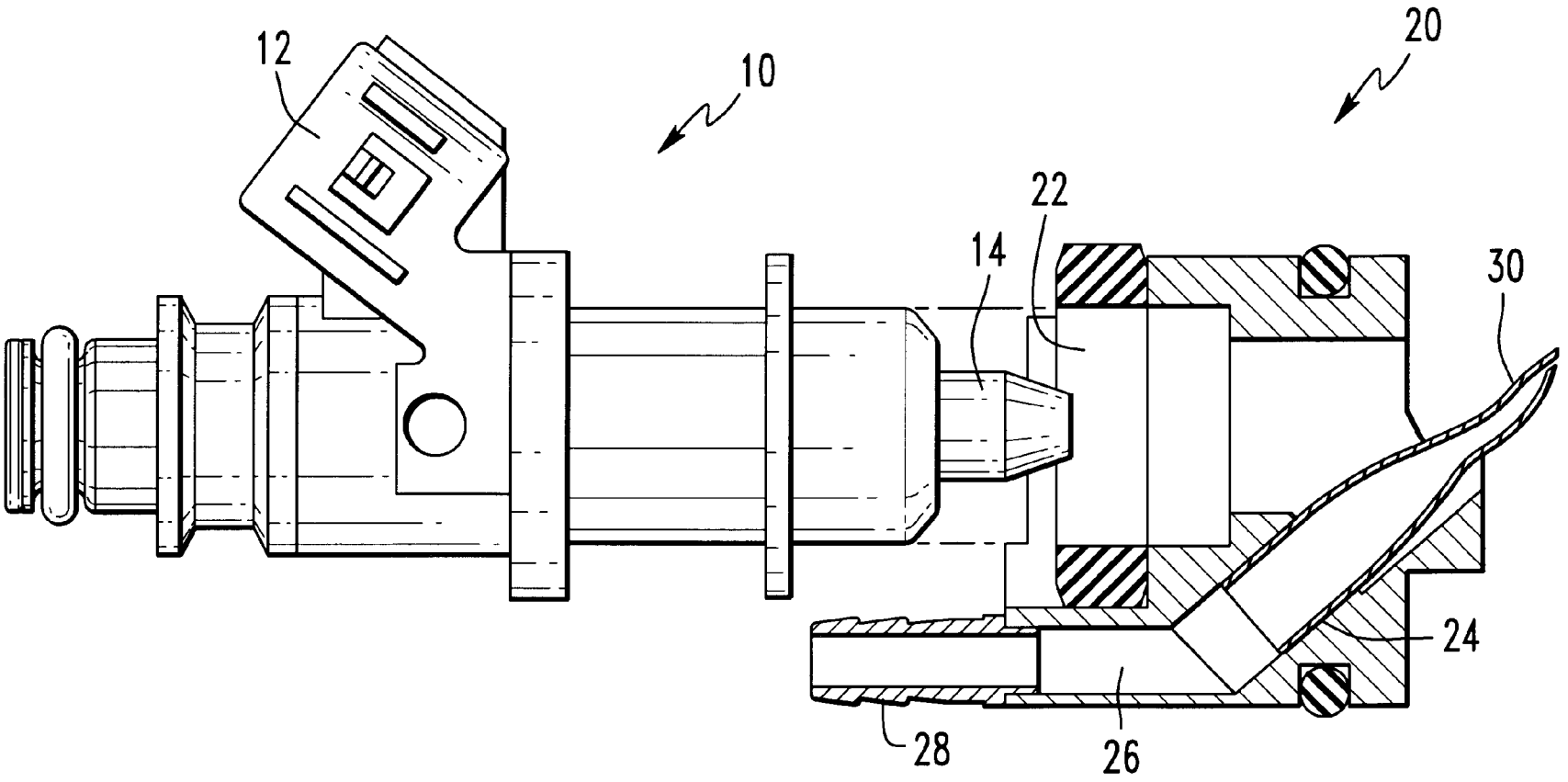
FIG. 3 shows the adapter of FIG. 2 associated with the fuel injector of FIG. 1.

FIG. 3 shows an exploded view of the fuel injector 10 and the adapter 20. The dashed lines in FIG. 3 show the path along which the injector is inserted into the cylindrical opening 22 which is shaped to receive it.

In FIG. 3 a deflector 30 is shown disposed within the opening 24 that is shaped to receive it. The components in FIG. 3 are shown in a partially exploded view in order to illustrate the cooperative nature of the components. In a typical application of the present invention, the adapter 20 is first manufactured as a separate component and then installed, with the deflector 30, in an engine block for the purpose of receiving the fuel injector 10 and placing the injector at precisely the desired location and relative angle to other components of the engine.

Figure 4:
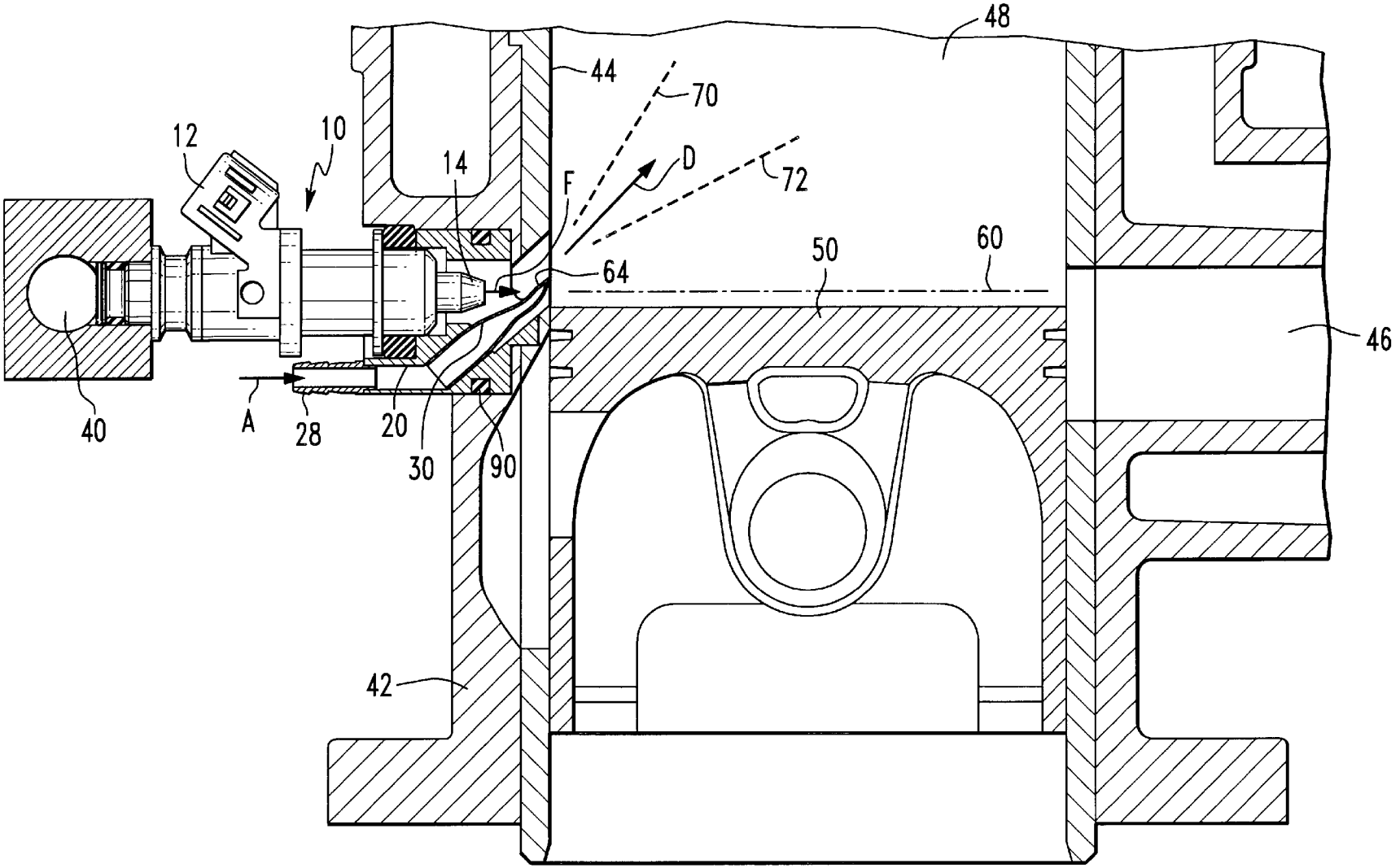
FIG. 4 shows the adapter and fuel injector of FIG. 3 attached to an engine block.

FIG. 4 shows the adapter 20 disposed within an opening of an engine block. The fuel injector 10 is disposed within the adapter 20 and held in place by an appropriate clamping means (not shown in FIG. 4). At one end of the injector 10, the tip 14 is provided with an opening through which the fuel can be emitted in the direction generally represented by arrow F. At the opposite end of the injector 10, a conduit is connected to a pressurized fuel rail 40. When activated by an appropriate electrical signal, a valve of the fuel injector opens and allows fuel to flow from the fuel rail 40, through the body of the injector 10, and out of the opening in the tip 14 as represented by arrow F.

The engine block 42 can be provided with a cylinder into which a cylinder liner 44 is disposed. An exhaust port 46 allows burnt gases to flow out of the combustion chamber near the upper end of the cylinder 48 during the later portion of the downstroke of the piston 50 and also the initial portion of the upstroke of the piston 50. In other words, after ignition of the fuel-air mixture within the combustion chamber of the cylinder 48, the piston 50 is forced downward until its upward edge moves sufficiently downward to open a portion of the exhaust port 46. The burnt fuel then passes out of the exhaust port 46 as the piston continues to move downward. As the piston 50 moves upward from bottom dead center, it assists in driving out the remaining burnt fuel through the exhaust port 46. Meanwhile, the fuel injector 10 is emitting fuel into the cylinder.

With continued reference to FIG. 4, it can be seen that the central axis of the fuel injector 10 is disposed generally perpendicular to the central axis of the piston 50 and cylinder 48. This defines a first axis 60 along which the fuel would normally be emitted as represented by arrow F. As can be seen in FIG. 4, the first axis 60 extends directly across the cylinder 48 and is generally coincident with the exhaust port 46. It might be expected that a certain amount of fuel emitted by the injector 10 might pass directly across the opening of the cylinder 48 and through the exhaust port 46 prior to the next ignition cycle. If this occurs, the raw fuel is emitted from the engine in the exhaust. Because of environmental concerns, it is undesirable to emit raw fuel in the exhaust of the engine.

With continued reference to FIG. 4, the deflector 30 is disposed at a location between the tip 14 of the fuel injector 10 and the cylinder 48. In other words, arrow F interferes with a portion of the deflector 30. When the fuel strikes the curved surface 64 of the deflector 30, it is deflected upward as represented by arrow D. Although arrows F and D have been used to describe the general direction of the fuel spray, it should be understood that the actual spray is not precisely defined by any single vector, but actually comprises a diverging group of droplets of fuel. This diverging group is represented by dashed lines 70 and 72. The surface of the deflector 64 deflects the fuel upward and away from the first axis 60 which would have been the normal path along which the spray would travel after being emitted by the injector 10. This deflection, along arrow D, is provided for the purpose of reducing the amount of raw fuel passing directly through the cylinder 48 and out of the exhaust port 46 prior to the subsequent ignition cycle.

The deflector 30 shown in FIG. 4 is hollow and provides a conduit along the length of the deflector and out of an aperture at the tip of the deflector. Air can be introduced, as represented by arrow A, into the barbed nipple 28 of the adapter 20. The pressurized air then flows upward through the deflector 30 and out of an aperture located near the tip of the curved surface of the deflector 30.

Figure 5A:
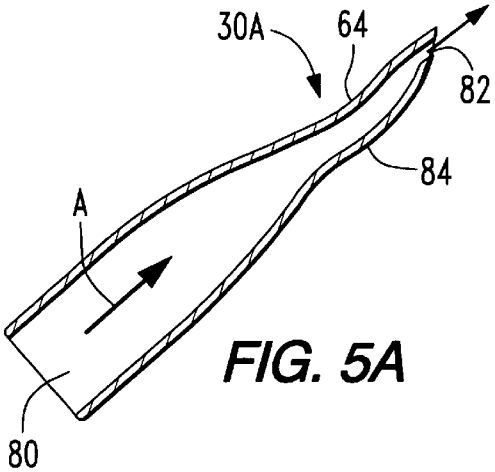
Figure 5B:
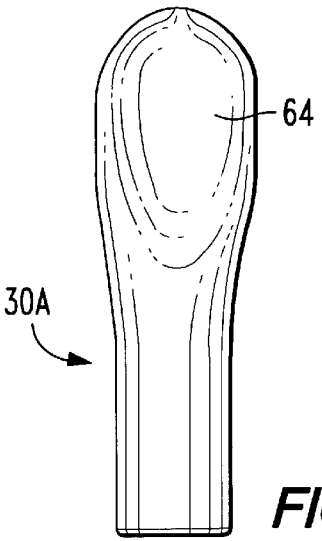

FIGS. 5A, 5B, 6A, 6B, 7A, and 7B show various views of different deflectors 30 that are useable in conjunction with engines made in accordance with the present invention. Deflector 30A shown in FIG. 5A is provided with a hollow internal portion 80 through which pressurized air can flow in the direction represented by arrow A. After passing through the length of the deflector 30A, the pressurized air then flows out of the aperture 82 and into the spray of fuel deflected by surface 64. In the illustration of FIG. 5A, surface 64 is concave. On the opposite side of the deflector, surface 84 is convex. In certain embodiments of the present invention, it might be desirable to deflect the spray of fuel with a convex surface instead of a concave surface. However, it should be understood that the precise shape and size of the deflecting surface of the deflector 30 is not limiting to the present invention but, instead, is determined by the conditions under which the present invention is intended for use. FIG. 5B is a top view of the illustration of FIG. 5A, showing the concave surface 64 of the deflector 30A.

Figure 6A:
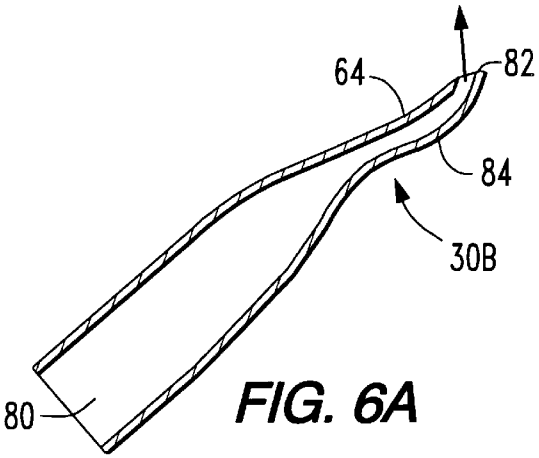
Figure 6B:
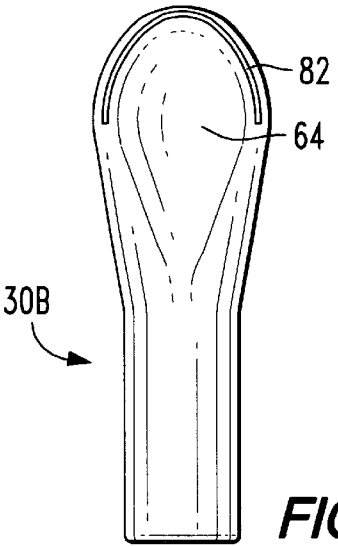

FIG. 6A is generally similar to that of FIG. 5A, but showing the tip of the deflector 30B being arranged so that the aperture 82 is located at a slightly different position than that of FIG. 5A. The concave surface 64 and convex surface 84 are also shown in FIG. 6A. FIG. 6B is a top view of the illustration of FIG. 6A.

Figure 7A:
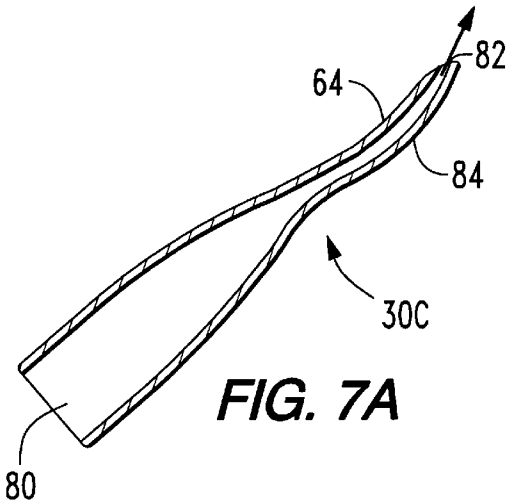
FIGS. 5A, 5B, 6A, 6B, 7A, and 7B show various types and views of deflectors that can be used in conjunction with the present invention.
Figure 7B:
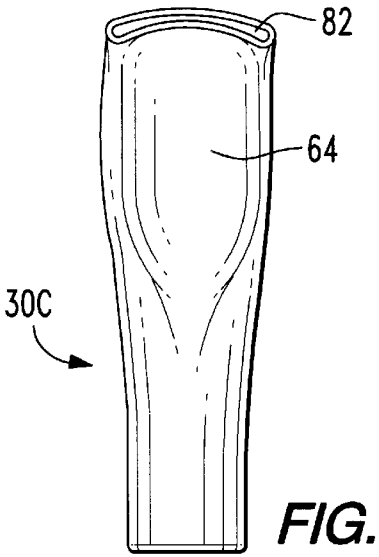

In FIG. 7A, the aperture 82 is located precisely at the tip of the flattened end of the deflector 30C. In FIG. 5A, the aperture 82 is located more through the convex surface 84 than the concave surface 64. In FIG. 6A, the aperture 82 is located more in the concave surface 64 than the convex surface 84. In FIG. 7A, the aperture 82 is located almost precisely at the tip of the flattened end of the deflector 30C, not favoring either the concave surface 64 or the convex surface 84.

Each of the deflectors shown in FIGS. 5A, 6A, and 7A provide slightly different spray patterns and could be preferable in certain embodiments of the present invention. In addition, it should be understood that the effective angle of the deflector relative to the first axis 60 described above in conjunction with FIG. 4 can be selected to suit particular applications. Furthermore, the depth of the concave surface 64 or the rise of the convex surface 84 can be varied to suit specific applications of the present invention.

Figure 8A:
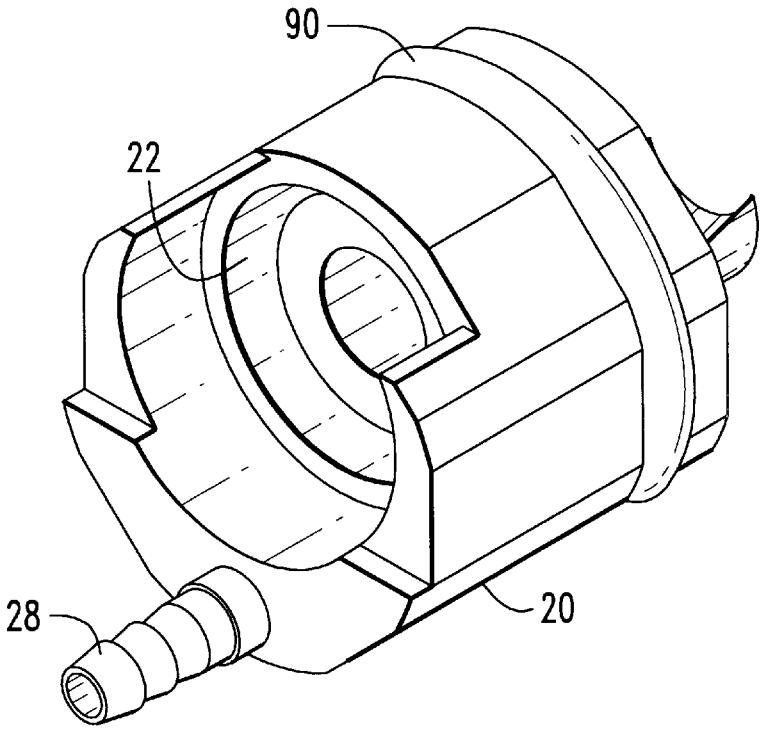
FIGS. 8A and 8B show two perspective views of the adapter of the present invention illustrated in FIG. 2.

FIG. 8A shows a perspective view of the adapter 20, showing the barbed nipple 28 and the opening 22 that is shaped to receive the fuel injector. An O-ring 90 is provided to seal the space around the barrel of the adapter 20 and prevent pressurized gas within the cylinder to escape around the outside surface of the adapter 20 between the adapter and the opening formed in the engine block to receive the adapter.

Figure 8B:
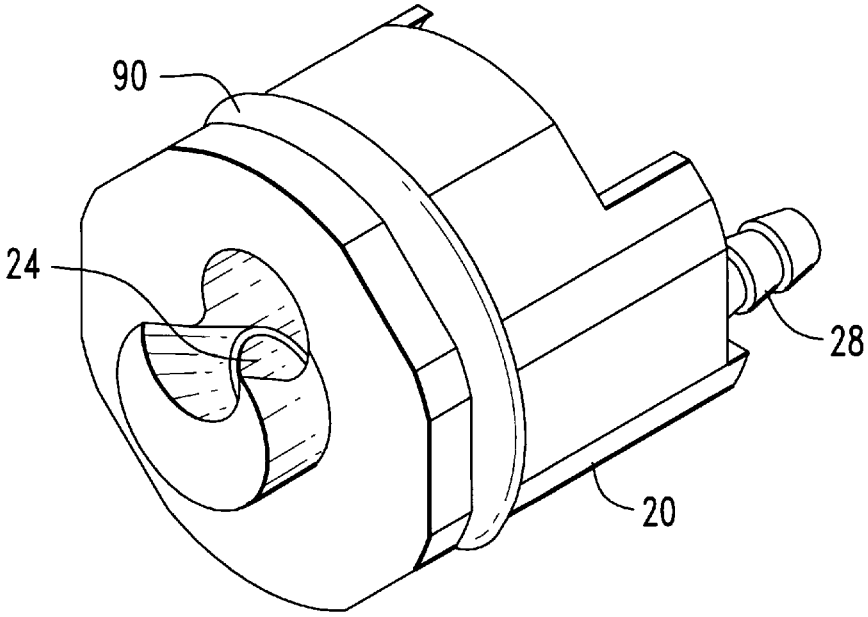

In FIG. 8B, the adapter 20 is shown in perspective view from a direction opposite to that of FIG. 8A. The opening 24, which is shaped to receive a deflector therein, is illustrated in FIG. 8B along with the barbed nipple 28 and the O-ring 90. The internal portions of the adapter are described above in conjunction with the sectioned views of FIGS. 2 and 3.

Although the present invention has been illustrated and described to show a particularly preferred embodiment, it should be understood that modifications of various parameters can be made within the scope of the present invention. For example, the surface of the deflector can be concave or convex and shaped in many different configurations to direct the deflected fuel spray in a particularly desirable direction, depending on the application with which the present invention is used. In addition, the pressurized air passing through the deflector, when a hollow deflector is used, can be provided from various sources such as a compressor or the crankcase of the engine. The location and shape of the aperture at the tip of the deflector can be modified in order to create certain air flow patterns that will result in desirable fuel spray patterns within the cylinder.

I claim:

1. An internal combustion engine, comprising:

an engine block having a cylinder formed therein;

a fuel injector attached to said engine block and disposed to emit a spray of fuel, in a direction generally along a first axis, through an opening formed in a wall of said cylinder; and a deflector disposed at least partially between said injector and said cylinder, said deflector being disposed at an angle to said first axis so that at least a portion of said spray of fuel emitted from said injector will strike a surface of said deflector.

2. The internal combustion engine of claim 1, wherein:

said surface of said deflector has a concave surface which said spray impacts after being emitted by said injector.

3. The internal combustion engine of claim 1, wherein:

said surface of said deflector has a convex surface which said spray impacts after being emitted by said injector.

4. The internal combustion engine of claim 1, wherein:

said deflector is hollow to form a conduit for a gas to flow through said deflector and out of an aperture formed proximate a tip of said deflector within said spray of fuel.

5. The internal combustion engine of claim 4, wherein:

said deflector is connected to a supply of pressurized air to cause said spray to be redirected away from said first axis by said surface and a flow of pressurized air out of said aperture.

6. The internal combustion engine of claim 5, wherein:

said spray is redirected in a direction toward a spark plug of said engine.

7. An internal combustion engine, comprising:

an engine block having a cylinder formed therein;

a fuel injector attached to said engine block and disposed to emit a spray of fuel, in a direction generally along a first axis, through an opening formed in a wall of said cylinder; and a deflector disposed at least partially between said injector and said cylinder, said deflector being disposed at an angle to said first axis so that at least a portion of said spray of fuel emitted from said injector will strike a surface of said deflector, said deflector being hollow to form a conduit for a gas to flow through said deflector and out of an aperture formed proximate a tip of said deflector within said spray of fuel.

8. The internal combustion engine of claim 7, wherein:

said surface of said deflector has a concave surface which said spray impacts after being emitted by said injector.

9. The internal combustion engine of claim 7, wherein:

said surface of said deflector has a convex surface which said spray impacts after being emitted by said injector.

10. The internal combustion engine of claim 7, wherein:

said deflector is connected to a supply of pressurized air to cause said spray to be redirected away from said first axis by said surface and a flow of pressurized air out of said aperture.

11. The internal combustion engine of claim 10, wherein:

said spray is redirected in a direction toward a spark plug of said engine.

12. An internal combustion engine, comprising:

an engine block having a cylinder formed therein;

a fuel injector attached to said engine block and disposed to emit a spray of fuel, in a direction generally along a first axis, through an opening formed in a wall of said cylinder; and a deflector disposed at least partially between said injector and said cylinder, said deflector being disposed at an angle to said first axis so that at least a portion of said spray of fuel emitted from said injector will strike a surface of said deflector, said surface of said deflector having a concave surface which said spray impacts after being emitted by said injector, said deflector being hollow to form a conduit for a gas to flow through said deflector and out of an aperture formed proximate a tip of said deflector within said spray of fuel.

13. The internal combustion engine of claim 12, wherein:

said deflector is connected to a supply of pressurized air to cause said spray to be redirected away from said first axis by said surface and a flow of pressurized air out of said aperture.

14. The internal combustion engine of claim 13, wherein:

said spray is redirected in a direction toward a spark plug of said engine.

* * * * *